US006398652B1

(12) United States Patent
Schweizer et al.

(10) Patent No.: US 6,398,652 B1
(45) Date of Patent: Jun. 4, 2002

(54) FLEXIBLE NUNCHAKU AND ITS USE

(75) Inventors: Achim Schweizer, München; Günther Schramm, Dachau, both of (DE)

(73) Assignee: Schramm Sport GmbH, Vierkirchen (DE)

( * ) Notice: Subject to any disclaimer, the term of this patent is extended or adjusted under 35 U.S.C. 154(b) by 0 days.

(21) Appl. No.: 09/699,401

(22) Filed: Oct. 31, 2000

(30) Foreign Application Priority Data

Nov. 3, 1999 (DE) ..... 199 52 920

(51) Int. Cl.[7] ..... F41B 15/02
(52) U.S. Cl. ..... 463/47.5
(58) Field of Search ..... 463/47, 47.5; 473/FOR 187

(56) References Cited

U.S. PATENT DOCUMENTS 3,934,877 A * 1/1976 White
4,070,023 A 1/1978 Cutler ..... 273/84 R
4,462,593 A 7/1984 Carty, Jr. ..... 273/84 R
5,547,190 A * 8/1996 Mackewich, Jr. et al.

FOREIGN PATENT DOCUMENTS

DE 90 06 137 9/1990
DE 296 11 999 10/1996

* cited by examiner

*Primary Examiner*—William M. Pierce

(57) ABSTRACT

A subject-matter of the invention is a flexible nunchaku having two striking bodies (3, 3') connected to an expander (2) which each have an inner body (4, 4') and in their longitudinal direction one jacket (5, 5') each made of plastic foam or foamed rubber, with the the inner body (4, 4') being formed in each case by a highly flexible hose (4, 4') without any filling of its inside which is inserted into the jacket (5, 5') and firmly attached. This nunchaku has the advantage of good flexibility with sufficient stability so that choking and blows with physical injury or damage are excluded therewith.

29 Claims, 5 Drawing Sheets

FLEXIBLE NUNCHAKU AND ITS USE

DESCRIPTION

The invention relates to a flexible nunchaku having two striking bodies connected to an cord which each have an inner body and in their longitudinal direction one jacket each made of plastic foam or foamed rubber.

Nunchakus are already known; however, these have the disadvantage that due to their low flexibility and their high weight they are suitable for choking and blows with physical injury and damage. This is the reason why these have not been allowed in Germany.

A piece of gymnastics and martial arts sports equipment is, for example, known from German Utility Model DE-GM 90 06 137 where the striking bodies connected to one another by a rope, which is optionally elastic, have a jacket made of plastic foam or foamed rubber, with an elastic plastic tube being let into said jacket and a flexible, solid plastic bar being cast into said elastic plastic tube and with said plastic bar being fixedly connected to said plastic tube (FIG. 2 thereof). This nunchaku, however, has the disadvantage, in particular due to the plastic bar, especially due to the fixed connection to the plastic bar, that it is not flexible enough, so that also due to the high weight choking is possible and blows can result in physical injury and damage. This is the reason why these have not come onto the German market since they are forbidden by police prohibition due to these properties. The same applies to the known piece of gymnastics and martial arts sports equipment also known from DE-GM 90 06 137 where solid striking bodies connected to one another by a rope, which is optionally elastic, are made of a plastic, with the rope having a plurality of compactions within the striking bodies (FIG. 1 thereof).

A nunchaku is also known from DE 296 11 999 U1 having two bars connected by a rope and/or a chain, with each bar being covered with a damping material. Due to the rigid bars, this nunchaku also has the said disadvantages of the possibility of choking therewith and the striking of blows which can result in physical injury or damage.

U.S. Pat. No. 4,462,593 also describes a nunchaku comprising two rigid bars connected by a cord, with each bar being covered by a damping jacket and whose two ends of each bar are connected to cap elements by springs; the cap elements are themselves also rigid and covered with a damping jacket. Due to the rigid bar elements, these nunchakus also have the disadvantages given above of the possibility of choking therewith and the striking of blows which can result in physical injury or damage; all this despite the resilient connections between the respective rigid main bar part and the rigid cap part. On the one hand, the bars making up the greater part of the striking bodies are rigid so that the possibility of choking therewith is not excluded, which is not mentioned anywhere in the said publication; and on the other hand, the springs cannot generate any sufficient resilience even on the ends in a transverse direction so that physical injury or damage cannot be definitely excluded in the event of blows either. In addition, there is the disadvantage of a plurality of parts, which makes the device complicated.

Nunchakus are known from U.S. Pat. No. 4,070,023 which comprise two rigid hollow bars connected to one another by a rope. It is clear that these have the above-mentioned disadvantages to a greater extent.

There is therefore a need for nunchakus, in particular for martial arts, by whose use choking and blows with resulting physical injury or damage are excluded.

It is therefore the object of the invention to provide a nunchaku which, while eliminating the disadvantages of the prior art, is substantially more flexible than the nunchakus of the prior art despite a good stability and stable attachment and which has superior damping, as well as the use of such a nunchaku.

The above has been achieved by the invention.

A subject matter of the invention is a flexible nunchaku with two striking bodies connected to an cord and having in each case an inner body and, in their longitudinal directions, in each case a jacket made of plastic foam or foamed rubber, characterized in that the inner body is formed in each case by a highly flexible hose without any filling of its inside which is inserted into the jacket and firmly attached.

In addition to the good resilience of the hose, it is very important that no component such as a bar is located in its inside. The required resilience with respect to the solutions of the prior art is ensured in this way. The striking bodies bend at just a low application of force so that a choking effect is prevented. Furthermore, the weight which is reduced by the hose without any solid component and which can be as low as about 100 g, contributes to the lack of hazard.

The hose advantageously has the following properties:

Bursting pressure: 16 to 20 bar, above all about 20 bar, at 1.25 to 2.5 cm (20° C.), cadmium-free, no algae formation, long life.

It is also preferred for the material of the hose to be a flexible rubber or a flexible plastic with textile reinforcement. The textile reinforcement can be fabric or fiber, with the first being preferred. The required resilience is thus achieved with sufficient shape maintenance (for example, no permanent kinking).

The flexible plastic of the hose is preferably a soft polyvinyl chloride (soft PVC), in particular RAU* PVC of the type 8589/8020.

The material of the hose advantageously has a Shore hardness A of 60 to 90, in particular of 70 to 80±3%.

The hose preferably has an inner hose part and an outer hose part, with it being preferred for the outer hose part to be softer than the inner hose part. It is particularly preferred for the outer hose part to have a Shore hardness A from 60 to 80, in particular of 70, and the inner hose part to have a Shore hardness A from 70 to 90, in particular of 80. An example for the outer hose part is the type PVC 7020 and for the inner hose part the type PVC 8008, in each case of the corporation of Gummi Aigner, 83527 Haag, Germany.

The hose can, for example, be a water hose.

According to a convenient embodiment, the cord is fastened to the striking bodies by being inserted into the hollow space of each of a respective rigid, fixed mouthpiece of the striking bodies forced into the respective jackets.

According to a variant of this embodiment, the connection between the cord and the mouthpiece is a snap closure. This can be as follows: the cord has at its one end the one part of a snap closure which is designed to engage a complementary part of the snap closure on the mouthpiece.

The last-given variant has the advantage that the snap closure can be adjusted so that the connection between the cord and the striking body disengages at a certain tensile force. This can also be effected using a screw connection.

According to a special advantageous embodiment of the nunchaku according to the invention, the cord is attached to a striking body by being inserted into an extension of the mouthpiece having at least two lugs located at the periphery and movable to and away from the interior of the extension, and having a cap pushed onto the extension and pressing the lugs onto the cord with a certain force, releasably by applying a tensile force sufficient for release from the pressing force of the lugs. The extension can consist of one piece with the mouthpiece. An alternative convenient form is an inserted into and fixedly connected to the mouthpiece in the form of a sleeve. In this case, advantageously the cord is pushed through the hollow space of the insert or only to a stop of it. The presence of two lugs is sufficient; however, more, for example four may be provided. Conveniently, the cap can expand conically towards the striking bodies; however, such devices can be present on both such devices.

Also the last mentioned embodiment has the advantage that at a certain tensile force of the cord the connection between the cord and the striking body is released because the cross-section of the cord is compressed so far that it is no longer held by the lugs and therefore slips out of the extension of the mouthpiece together with the cap.

The firm attachment of the hose is advantageously present at its ends. This is a substantial contribution to the stability of the nunchaku. This is also surprising with respect to the prior art, since in accordance therewith reinforcing elements are incorporated over the whole length of the striking bodies and the nunchakus thus had insufficient resilience and too much weight.

A little air can be present between the hose and the jacket, which increases resilience, whereas the mouthpiece and the sleeve (described in detail below) should be forced into the jacket in order to achieve sufficient stability.

Suitably, the striking bodies have a length of 25 to 40 cm, in particular 30 cm. Advantageously, the length of the hose assuming the middle region of the striking bodies between the mouthpiece and the sleeve at the respective ends of the striking bodies is about half the total length of the striking bodies. Conveniently, the diameter of the hose is 1 to 2 cm, preferably 1.3 cm, of which the clearance is advantageously 50 to 70%, preferably 60%.

According to one embodiment, the end of the hose facing the cord is fastened in the striking body by being inserted into the hollow space end, being pushed onto and/or adhesively bonded to the end of the mouthpiece remote from the insertion point of the cord. The cord can be pushed up to the connection point of the hose in the mouthpiece.

According to another embodiment, the end of the hose facing the cord is fastened in the striking body at the end of the mouthpiece remote from the insertion point of the cord by a screw connection by means of a thread at the end of the mouthpiece remote from the insertion point of the cord by means of a thread complementary thereto at the said end of the hose.

According to an embodiment, the end of the hose remote from the cord is fastened in the striking body by being inserted into the hollow space end, being pushed onto and/or adhesively bonded to the open end facing the cord of a sleeve forced into the respective jacket at its end remote from the cord.

According to another embodiment, the end of the hose remote from the cord is fastened in the striking body at the open end of the sleeve by a screw connection by means of a thread at the open end facing the cord of a sleeve forced into the respective jacket at its end remote from the expander and by means of a thread complementary thereto at the said end of the hose.

According to an advantageous, special embodiment, the sleeve consists of a tubular cylinder and a plug removably closing the end remote from the cord. This has the advantage that in this way by removing the plug, ballast material, such as granulates, can be simply introduced into the sleeve, whereupon the sleeve can be closed with the plug.

The weight of the nunchaku can be increased by the introduction of ballast material, such as granulates, into the hollow space of the sleeve.

Preferably the material of the plastic foam of the jacket is not cross-linked soft polyethylene foam or not cross-linked polyurethane foam.

It is also preferred for the material of the plastic foam of the jacket to be closed-pored. In this way, grime effects are better avoided and the grip is more pleasant. While an open-pored material can also be used, such is less washable and so becomes dirty easier.

The thickness of the jacket is advantageously 0.7 to 1.7 cm, in particular 1.7 cm.

The material of the expander is advantageously a rubber braided with textile material, in particular rubber linen. The textile, in turn, can be a fabric or a fiber, with the former being preferred.

The material of the cord preferably has the following properties:

diameter: 5 to 10 mm, in particular to 9 mm, more particularly 8 mm weight: 3 to 6 kg/100 m, in particular about 4.5 kg/100 m breaking load: 250 to 350 daN, in particular about 300 daN elongation: 100 to 200%, in particular 150%.

It is also preferred for the braiding to be high-strength polyamide.

It is further advantageous for the material of the mouthpiece and of its insert to be polyethylene.

Furthermore, it is advantageous for the material of the sleeve to be polyvinyl chloride.

A subject-matter of the invention is also the use of the nunchaku according to the invention for sports, in particular martial arts sports. Examples for this are budo, karate, judo, taekwondo, jiu-jitsu and kobudo. It is primarily suitable for exercises of skill.

Due to the particularly advantageous properties which stand out from the known nunchakus, the nunchaku according to the invention is the first nunchaku in Germany to be allowed by the police.

The invention is described in more detail by way of the following example representations with reference to the enclosed drawings.

Figure 1:
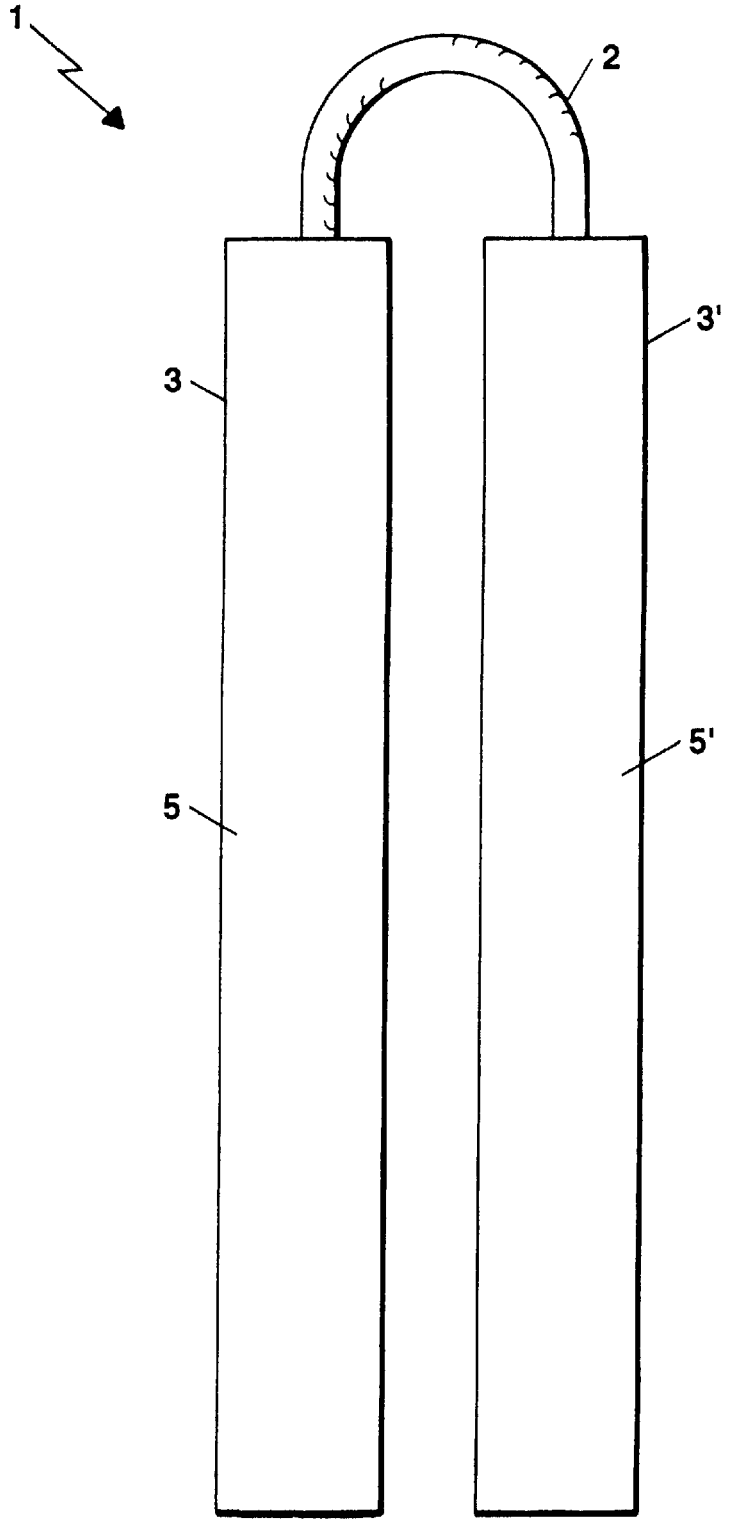
FIG. 1 shows a view of an embodiment of the nunchaku according to the invention.
Figure 2:
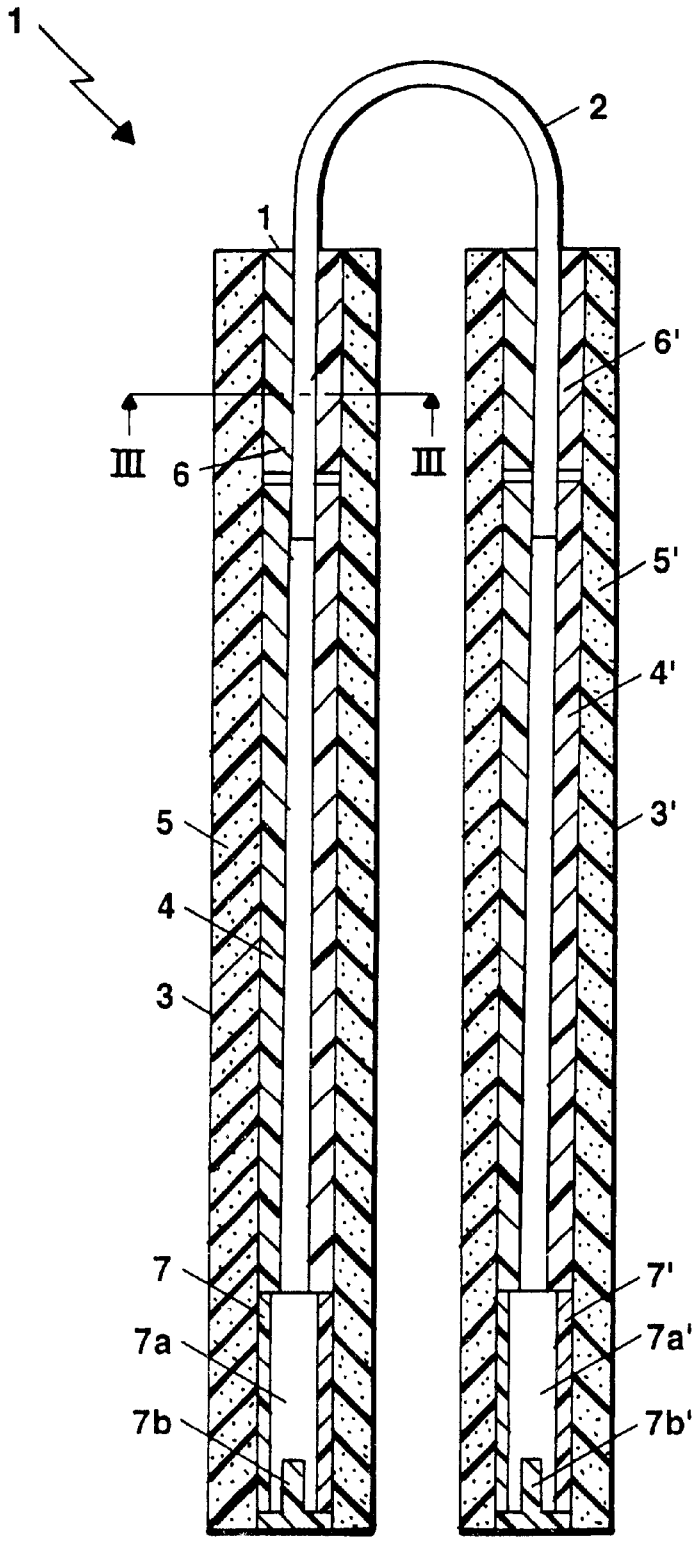
FIG. 2 shows the same embodiment in a longitudinal section.

A nunchaku 1 is shown in FIGS. 1 and 2 having two striking bodies 3, 3', which are connected to an cord 2 having a diameter of 8 mm and made of rubber braided with a textile fabric.

Figure 3:
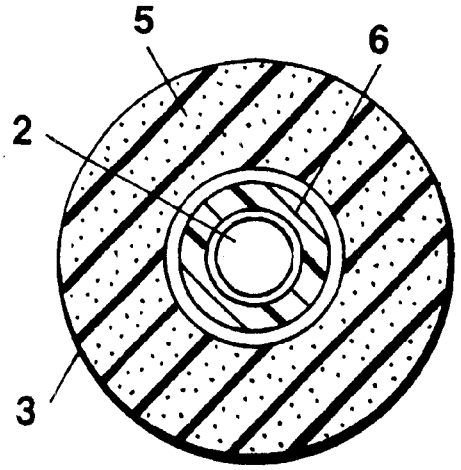
FIG. 3 shows a striking body of the same embodiment in cross-section along the line I—I of FIG. 2.
Figure 4:
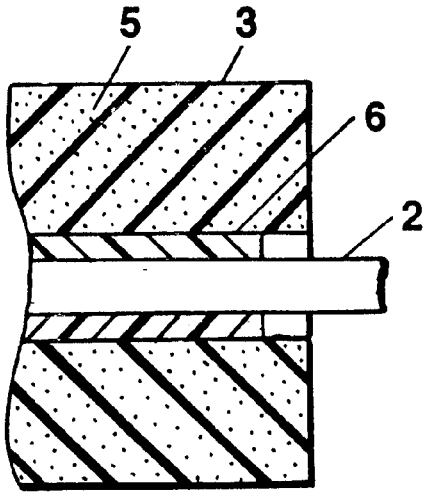
FIG. 4 shows a detail of FIG. 2 inside the circle, marked with a Z, about a mouthpiece with expander.

The further details can be seen from FIGS. 2, 3, and 4. The striking bodies 3, 3' each have a highly flexible hose 4, 4' made of soft polyvinyl chloride with textile reinforcement and a jacket 5, 5' of not cross-linked, closed-pored soft polyethylene foam around their length, The hoses 4, 4' are surrounded by the jackets 5, 5', it being possible that a little air is present therebetween. Furthermore, one mouthpiece 6, 6' each made of polyethylene is located at the end facing the cord 2 firmly inserted or forced into the jackets 5, 5' and one sleeve 7, 7' each made of polyvinyl chloride at the end remote from the cord 2 firmly inserted or forced into the jackets 5, 5'. In the form shown, this comprises a tubular cylinder 7*a* and a plug 7*b* removably closing the end remote from the cord 2 (details are shown in FIG. 4). The two ends of the cord 2 are pushed through the hollow spaces of the mouthpieces 6, 6' and adhesively bonded thereto. The hose 4, 4' is adhesively bonded to the end of the respective mouthpiece 6, 6' remote from the cord 2, with this optionally being able to be pushed onto the mouthpiece 6, 6' due to a somewhat greater width of the aperture of the hose or, vice versa, the mouthpiece 6, 6' onto the hose 4, 4' with correspondingly reversed different widths. In the latter variant, a connection can also exist between the cord 2 and the hoses 4, 4'.

The hose is adhesively bonded to the end of the respective sleeve 7, 7' facing the cord 2. As between hose 4, 4' and mouthpiece 6, 6', the attachment can be reinforced by adhesive bonding by means of coupling connection.

Also one or more screw connections (not shown) can be present between the hose 4, 4' and the mouthpiece 6, 6' and/or the sleeve 7, 7'.

FIG. 3 shows the different components of a striking body 3 in cross-section, with the arrangement of the components above one another being illustrated.

This nunchaku has already been tried out for martial art skill exercises, and it was discovered that the blows with it are completely harmless. It was also discovered that choking is not possible therewith.

Figure 5:
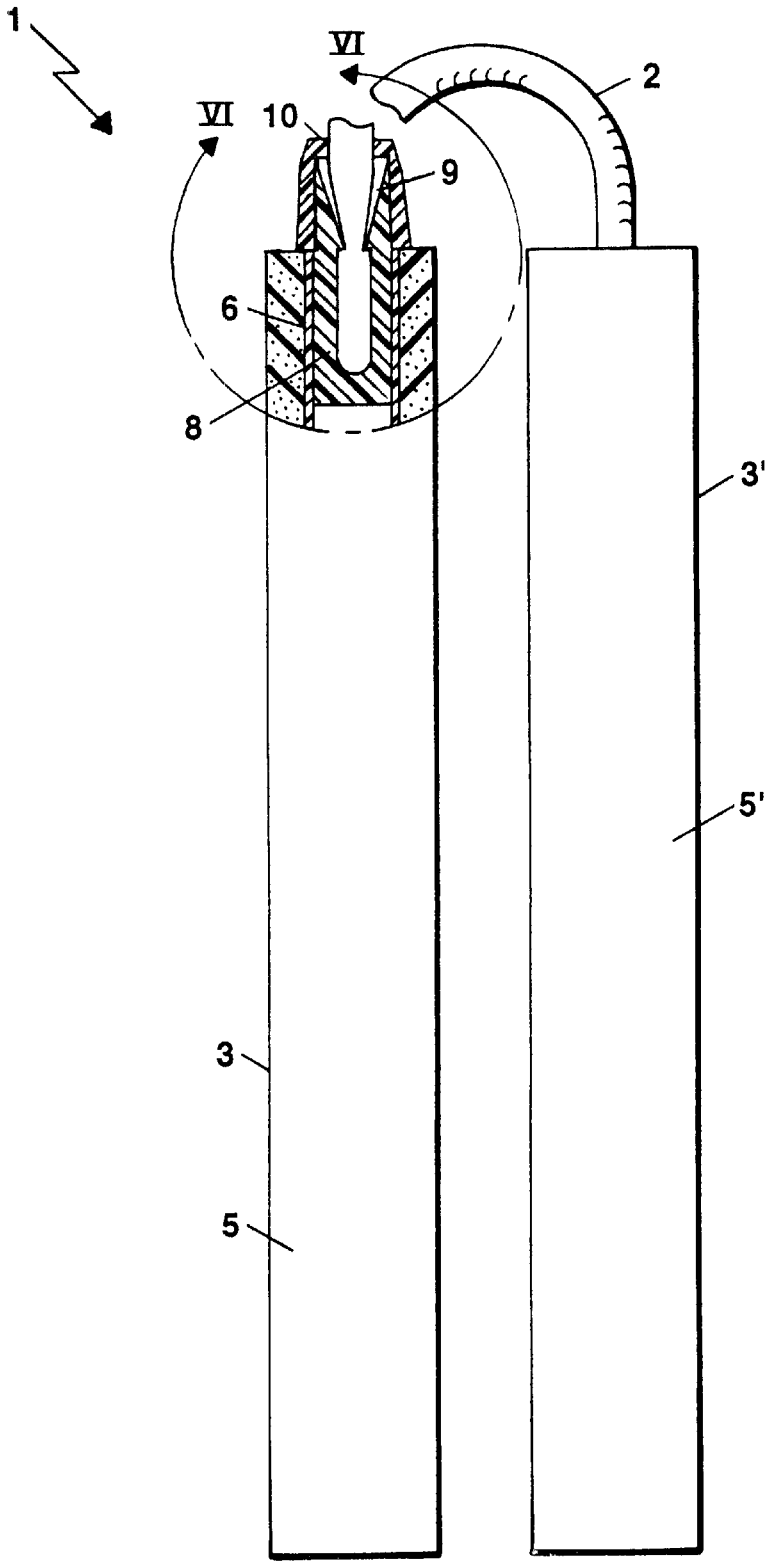
FIG. 5 shows another embodiment of the nunchaku according to the invention having a connection device between the cord and the striking body for their releasable connection, with a longitudinal section through the connection device in the upper part of the one striking body inside the circle designated with Y, in a connected state, with the cord being broken away before the connection point.
Figure 6:
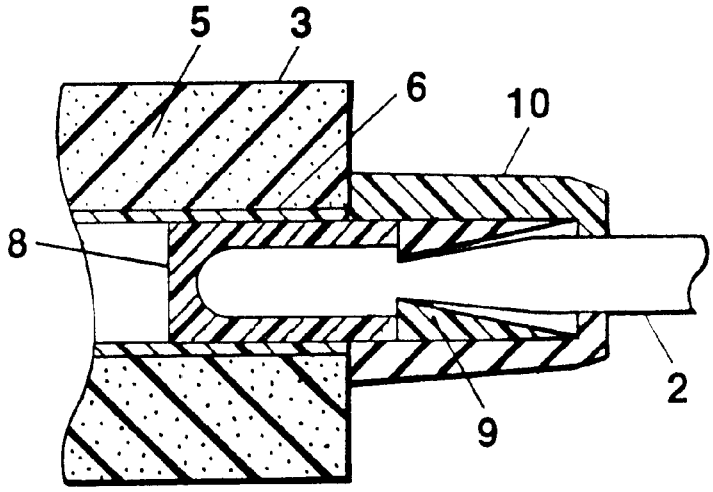
FIG. 6 shows a detail of FIG. 5 inside the circle designated with Y about a connection device in a connected state.
Figure 7:
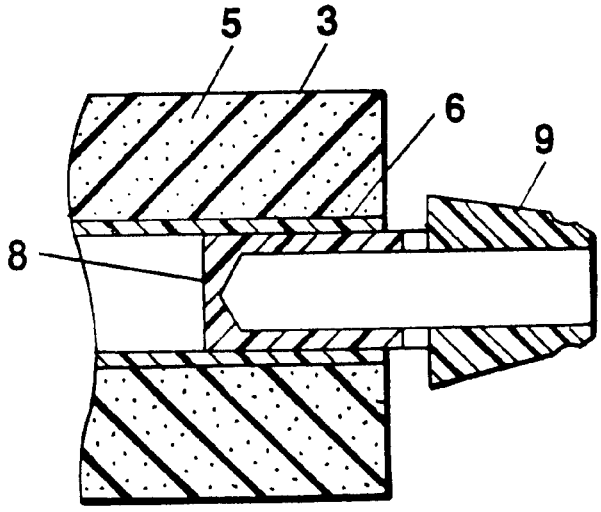
FIG. 7 shows a detail of FIG. 5 inside the circle designated with Y about a connection device, but in a released state.

According to a modified embodiment according to FIGS. 5 to 7 of the nunchaku according to the invention, the cord 2 is inserted through the hollow space of such a mouthpiece 6 which has at its end facing the cord 2 an insert 8 made of polyethylene, inserted into and fixedly connected to it and formed as a sleeve, and through the hollow space of said insert 8 up to its end remote from the cord or up to a stop in the insert 8. The inset 8 has lugs 9 on two sides movable toward and away from the hollow space of the insert 8 (lower part of the connection device) A conical cap 10 made of polyethylene and expanding towards the striking body 3 is pushed onto the insert 8 receiving the cord (upper part or the connection device) and presses the lugs 9 of the insert 8 inwardly and tightly onto the cord 2 in order to ensure a solid fit of the cord 2, whereby the cord 2 is firmly fixed in place in the striking body 3. If the striking bodies 3, 3' are pulled with a certain tensile force, the cross-section of the cord 2 compresses so far that the force of the lugs 9 is no longer sufficient to hold the cord 2 fast, with the required tensile force to be applied to the striking bodies 3, 3' conveniently being set so high that no impairment results during use in martial arts. The result is that the cord 2 slips out of the device and thus there is no longer any connection between the two striking bodies 3, 3' of the nunchaku. In this way, the possibility is further eliminated of the nunchaku being used as a choking weapon. The nunchaku is ready for use again by a simple assembly of the two striking bodies 3, 3' by a repeated insertion of the cord 2 through the hollow spaces of the cap 9 and of the insert 8 of the relevant striking body 3 up to the end or stop, respectively, of the insert 8 and pushing the cap 10 onto the insert 8.

What is claimed is:

1. A flexible nunchaku with two striking bodies (3,3') connected to cord (2), each of the striking bodies having an inner body (4,4') and a longitudinally extending jacket (5,5') made of plastic foam or foamed rubber, wherein:

each inner body (4,4') is formed by a flexible hose which is inserted into the jacket (5,5') and firmly attached; and the flexible hose of each inner body has an interior hollow space which is devoid of any filling material.

2. A nunchaku according to claim 1, characterized in that the hose (4, 4') has the following property:

Bursting pressure: 16 to 30 bar at 1.25 to 2.5 cm (20° C.).

3. A nunchaku according to claim 2, wherein the material of the hose (4,4') is one of a flexible rubber and a flexible plastic with textile reinforcement.

4. A nunchaku according to claim 3, wherein the flexible plastic of the hose (4,4') is a polyvinyl chloride.

5. A nunchaku according to claim 1, wherein the material of the hose (4,4') has a Shore hardness A of 60 to 90.

6. A nunchaku according to claim 1, wherein the hose (4,4') has an inner hose part and an outer hose part.

7. A nunchaku according to claim 6, wherein the outer hose part of the hose (4,4') is softer than the inner hose part.

8. A nunchaku according to claim 6, wherein the outer hose part of the hose (4, 4') has a Shore hardness A of 60 to 80 and the inner hose part a Shore hardness A of 70 to 90.

9. A nunchaku according to claim 1, wherein the cord 2 is fastened to each striking body (3,3') by insertion into a hollow space of a rigid, fixed mouthpiece (6,6') of said striking body (3,3'), which mouthpiece is forcibly inserted into the respective jacket (5,5').

10. A nunchaku according to claim 9, wherein the cord 2 has at one end thereof one part of a snap closure which is engageable with a complementary part of the snap closure on the mouthpiece (6,6').

11. A nunchaku according to claim 9, wherein the cord (2) is attached to a striking body (3) by being inserted into an extension (8) of the mouthpiece (6) having at least two peripheral rugs (9) which are toward movable toward and away from an interior of the extension (8), and having a cap (10) pushed onto the extension (8) and pressing the lugs (9) onto the cord (2) releasable by applying a tensile force sufficient for release from the pressing force of the lugs (9).

12. A nunchaku according to claim 9, wherein an end of the hose (4,4') adjacent the cord (2) is fastened in the striking body (3,3') by being inserted into an interior thereof, and held thereby being pushed onto an end of the mouthpiece (6,6'), at a location remote from the insertion point of the cord (2).

13. A nunchaku according to claim 12, wherein the end of the hose adjacent the cord is adhesively bonded to said end of the mouthpiece.

14. A nunchaku according to claim 9, wherein an end of the hose (4,4') adjacent the cord (2) is fastened in the striking body (3,3') at an end of the mouthpiece (6,6') remote from the insertion point of the cord (2) by a screw connection by means of a first thread at the end of the mouthpiece (6,6') remote from the insertion point of the cord (2) and by means of a second thread, complementary to the first thread, at the end of the hose (4,4').

15. A nunchaku according to claim 9, wherein an end of the hose (4,4') adjacent the cord (2) is fastened in the striking body (3,3') by being inserted into an interior thereof, and held thereby being adhesively bonded to an end of the mouthpiece (6,6'), at a location remote from the insertion point of the cord (2).

16. A nunchaku according to claim 1, wherein the firm attachment of the hose (4,4') is present at ends thereof.

17. A nunchaku according to claim 16, wherein an end of the hose (4,4') which is remote from the cord (2) is fastened in the striking body (3,3') by being inserted into the hollow space end, and held thereby being pushed onto an open end facing the cord (2) of a sleeve (7,7') forced into the respective jacket (5,5') at an end thereof remote from the cord (2).

18. A nunchaku according to claim 17, wherein the sleeve (7,7') consists of a tubular cylinder (7*a*, 7*a*') and a plug (7*b*, 7*b*') removably closing an end of the cylinder remote from the cord (2).

19. A nunchaku according to claim 16, wherein an end of the hose (4,4') remote from the cord (2) is fastened in the striking body (3,3') at an open end of the sleeve (7,7') by a screw connection by means of a thread at the open end facing the cord (2) of a sleeve (7,7') forced into the respective jacket (5,5') at its end remote from the cord (2) and by means of a thread complementary thereto at the said end of the hose (4,4').

20. A nunchaku according to claim 19, wherein the end of the hose adjacent the cord is adhesively bonded to said open end of said sleeve.

21. A nunchaku according to claim 16, wherein an end of the hose (4,4') which is remote from the cord (2) is fastened in the striking body (3,3') by being inserted into the hollow space end, and held thereby being adhesively bonded to an open end facing the cord (2) of a sleeve (7,7') forced into the respective jacket (5,5') at an end thereof remote from the cord (2).

22. A nunchaku according to claim 1, wherein the material of the plastic foam of the jacket (5,5') is not cross-linked soft polyethylene foam or not cross-linked polyurethane foam.

23. A nunchaku according to claim 22, wherein the material of the plastic foam of the jacket (5,5') is closed.

24. A nunchaku according to claim 1, wherein the material of the cord (2) is a rubber braided with textile material.

25. A nunchaku according to claim 24, wherein braiding of the rubber of the cord (2) is high-strength polyamide.

26. A nunchaku according to claim 1, wherein the material of the cord (2) has the following properties:

diameter: 5 to 10 mm weight: 3 to 6 kg/100 m breaking load: 250 to 350 daN extension: 100 to 200%.

27. A nunchaku according to claim 1, wherein the material of the mouthpiece (6,6') is polyethylene.

28. A nunchaku according to claim 1, characterized in that the material of the mouthpiece (6, 6') is polyvinyl chloride.

29. Use of the nunchaku according to claim 1 for martial arts.

* * * * *